United States Patent [19]

Tomaiuolo et al.

[11] 4,443,257

[45] Apr. 17, 1984

[54] STABILIZING MIXTURE FOR A CHEMICAL COPPER PLATING BATH

[75] Inventors: Francesco Tomaiuolo; Mauro Bocchino, both of Turin, Italy

[73] Assignee: Alfachimici S.p.A., Turin, Italy

[21] Appl. No.: 466,658

[22] Filed: Feb. 15, 1983

[30] Foreign Application Priority Data

Mar. 9, 1982 [IT] Italy ..... 67272 A/82

[51] Int. Cl.[3] ..... C23C 3/02

[52] U.S. Cl. ..... 106/1.23; 106/1.26; 427/305

[58] Field of Search ..... 106/1.23, 1.26

[56] References Cited

U.S. PATENT DOCUMENTS 3,361,580 1/1968 Schneble et al. ..... 106/1.23
3,485,643 12/1969 Zeblisky et al. ..... 106/1.23
3,804,638 4/1974 Jonker et al. ..... 106/1.23

*Primary Examiner*—Lorenzo B. Hayes
*Attorney, Agent, or Firm*—Young & Thompson

[57] ABSTRACT

An aqueous solution for electroless autocatalytic copper plating, containing a source of cupric ions, a source of hydroxylic ions, a reducing agent and a complexing agent in such a quantity as to render soluble the cupric ions in an alkaline medium, which further contains a stabilizing mixture formed by allylthiourea, at least a ferrocyanide of alkali metal or of ammonium ion, and at least an octylphenylether of ethylene polyoxide with 9–10 moles of ethylene oxide for each mole of octylphenol, the said three stabilizing compounds exerting a synergical action.

This solution shows a very good stability and produces copper deposits having clear and brilliant appearance and good ductility properties.

19 Claims, No Drawings

STABILIZING MIXTURE FOR A CHEMICAL COPPER PLATING BATH

BACKGROUND OF THE INVENTION

This invention relates to an aqueous solution for electroless autocatalytic copper plating, containing a source of cupric ions, a source of hydroxylic ions, a reducing agent and a complexing agent in such a quantity as to render soluble the cupric ions in an alkaline medium.

The electroless autocatalytic copper plating baths, also called "chemical copper baths", are capable of depositing a layer of copper onto a catalytic support, without the aid of an outer source of electrons. Generally, these baths are constituted by aqueous solutions containing a copper salt, a copper complexing agent, a reducing agent and a regulator of the pH.

The copper may be used in the form of sulphate, halid, nitrate, fluoroborate, acetate or in the form of other inorganic or even organic salts. Generally, for economical reasons it is preferred to employ the copper in the form of pentahydrated sulphate.

The function of the complexing agent is to keep the copper in solution in the alkaline medium which is necessary for the deposition reaction. To this end it is possible to utilize Rochelle salt (sodium and potassium tartrate) or gluconic acid or gluconates, nitrilotriacetic acid or its alkaline salts, triethanolamine, or also complexing agents such as ethilene diamine tetracetic acid and its sodium salts, N-hydroxy-ethyl-ethylen-diamine triacetate, N,N,N$^1$,N$^1$,tetra-(2-hydroxypropyl)ethylenediamine etc.

The copper reducing agent normally used in the chemical copper baths is formed by formaldehyde or its derivatives or precursors, such as paraformaldehyde, trioxane or the like. Also utilized as reducing agents are the borohydrides of alkaline metals, such as sodium borohydride, or the boranes of the dimethylaminoborane type etc. To this end one may use also hypophosphites of alkaline metals.

The function of the regulator of the pH is to keep an optimal alkalinity degree for the oxidoreduction reaction which leads to the deposition of a layer of copper onto the catalytic support. Normally, the work is carried out with pH values between 10 and 14, and to keep these pH values sodium or potassium hydroxide is used.

Besides these fundamental components, the chemical copper baths also contain a series of products, present therein in small concentrations, such as stabilizers, wetting agents and so on.

The products which exert a stabilizing action and which are used in the common practice generally include mercury salts, cyanides of alkali metals, organic nitriles or compounds containing sulphur in bivalent form, such as 2-mercaptobenzotriazole, thiourea, inorganic sulphides such as the sulphides of alkali metals, or thiocyanates or dithionates of alkali metals. Generally these stabilizers are catalytic poisons, and many of them have the characteristic of greatly reducing the speed of deposition, or, in the extreme cases, even of completely locking the bath, i.e. rendering the same non autocatalytic.

In the use of these chemical copper baths to metallize metallic surfaces it is only necessary to carry out a thorough degreasing of the surfaces. However, when it is desired to metallize non metallic surfaces it is necessary for these surfaces to be rendered catalytic and hence receptive in respect of the subsequent deposition of chemical copper.

To this end, generally, a treatment is carried out whose function is to carefully degrease the surfaces and to condition them in order to promote, in the subsequent catalysis stage, the adhesion of a thin and uniform layer of a noble metal.

The successive operation includes bringing said surfaces into contact with the catalyst solution which generally is based on palladium chloride and stannous chloride in a solution acidic by presence of HCl or in saline solution with NaCl or LiCl. This solution contains a compound between palladium and tin, present in colloidal form. Thereafter, the acceleration stage is carried out, whose function is to prevent coarse catalyst particles, which do not adhere to the substrate to be metallized, to be transferred into the chemical copper bath. Furthermore, this bath has the function of increasing the palladium/tin ratio within the colloidal complex in order to increase its catalytic power.

Generally, this solution is a solution acidic by presence of fluoboric acid, perchloric acid or the like, or it is a solution alkaline by presence of NaOH or other substances.

The electroless deposition of copper is applied in the decorative field and in the electroforming technique, in which onto a support of plastics, rendered conductive by a deposit of chemical copper, there is electrodeposited a suitable thickness of metal which thus can assume shapes which cannot be obtained by any other working technique. The electroless copper deposition, however, finds its application above all in the electronic field, and in particular in the production of printed circuits with metallized holes.

To obtain a consistent thickness in an acceptable time it is necessary to use a bath having a high deposition speed, which generally operates at a high temperature or contains a considerable concentration of active components, such as the source of cupric ions and the reducing agent. In the practice, the conduction of baths having these operative characteristics proves to be very difficult because of the high unstability exhibited by these baths, with consequent copper plating of the bottom of the tanks and uncontrolled decompositions.

This invention finds its application in this field, and its aim is to allow an optimal stabilization of the bath without jeopardizing its operative characteristics of deposition speed and the physical characteristics such as gloss and ductility, of the deposit which is obtained.

BRIEF SUMMARY OF THE INVENTION

The object of the present invention is to stabilize a bath for electroless autocatalytic deposition of copper by using a mixture of stabilizers which, taken in their whole, will act sinergycally and in a particularly effective manner.

This object is attained according to the invention by means of an aqueous solution for electroless autocatalytic copper plating, containing a source of cupric ions, a source of hydroxylic ions, a reducing agent and a complexing agent, in such a quantity as to render soluble the cupric ions in an alkaline medium, characterized in also containing a stabilizing mixture formed by allylthiourea, at least a ferrocyanide of alkali metal or of ammonium ion, and at least an octylphenylether of ethylene polyoxide with 9–10 moles of ethylene oxide for each mole of octylphenol, the said three stabilizing compounds exerting a synergical action.

The allylthiourea allows to obtain a particularly brilliant and clear deposit without stains or halos, contrarily to the thiourea which produces irregular deposition effects and aspects of the surface. The allylthiourea exerts its action in an effective manner at concentrations ranging from traces to some milligrams per liter, beyond which, since it is a catalytic poison as are all the bivalent sulphur compounds, it would be capable of completely locking the bath and thus inhibiting the deposition of copper. The optimal range of concentration is from 0.1 to 2.5 ppm.

The ferrocyanide may be present in the form of a salt of alkali metals or of ammonium ions, but preferably it is in the form of a potassium salt. The ferrocyanide acts in a sufficiently wide range of concentrations which extends from 100 to 3000 ppm. The optimal range for it to concretely exert the synergical stabilizing action in co-operation with the other two stabilizers which form the object of the present invention, ranges between 500 to 1500 ppm.

The third concerned stabilizer is an ethylene polyoxide octylphenylether with 9–10 moles of ethylene oxide for each mole of octylphenol, with an average molecular weight of about 650. This product is known under the trade name of Triton x-100 and is produced by Rohm and Haas Co. The Triton x-100 is a particularly effective surface-active agent and is already utilized as such in the preparation of baths for electroless deposition of copper. However, according to the present invention the Triton x-100 is specifically utilized as a stabilizing agent concurrently with the other two stabilizing agents described hereinabove, and not in view of its surface-active action. This will be pointed out in the following Examples by the circumstance that when another surface-active agent, pertaining however to a chemical family which is very similar to that of the Triton x-100, is utilized to attain this end, the synergical action of stabilization disappears. The Triton x-100 may be present in concentrations ranging from 0.1 to 5 g/l; but it exerts an optimal action according to the purposes of this invention at concentrations from 0.4 to 0.8 g/l. At concentrations lower than 0.4 g/l the deposition speed of the bath increases significantly, but its stability is not sufficiently reliable. If the limit of 0.8 g/l is exceeded, the deposition speed decreases considerably without any appreciable improvement of the stability of the bath.

The said three compounds, in their mixture and at the concentrations forming the subject-matter of the present invention, have shown an unexpected synergical action which at the respective concentrations was so effective that even if only one of the three agents were missing, the stabilizing synergical action would result in being much more limited.

According to the present invention it is possible to obtain an optimal utilization of an electroless copper plating bath which has, as its peculiar characteristic, a high but controlled speed of deposition.

DETAILED DESCRIPTION OF PREFERRED EMBODIMENTS

For a better understanding of the subject of this invention some Examples will now be described which emphasize the validity of the synergical action exerted by the said stabilizers when they are utilized simultaneously.

EXAMPLE 1

A series of baths were prepared which differ from each other in the stabilizing system employed, but have a common base composition as follows:

$CuSO_4.5H_2O$: 12 g/l
HCHO: 5 g/l
N,N,N$^1$,N$^1$,tetra(2-hydroxypropyl)-ethylenediamine: 20 g/l
NaOH: 8.5 g/l These baths were subjected to a treatment of accelerated decomposition to emphasize the effective differences of stability. To this end they were heated at 70° C. and treated with an equal surface of filter paper previously impregnated with catalyst and activated. In the following Table 1 there are shown the different systems of stabilizer used and the corresponding decomposition times, obtained by averaging at least three experimental data.

TABLE 1

| STABILIZING SYSTEM | DECOMPOSITION TIME (minutes) at 70° C. |
|---|---|
| (1) None | 2 |
| (2) 1.5 mg/l Allylthiourea | 20 |
| (3) 1 g/l $K_4Fe(CN)_6$ | 30 |
| (4) 0.5 g/l Triton x-100 | 10 |
| (5) 1.5 mg/l Allylthiourea + 1 g/l $K_4Fe(CN)_6$ | 35 |
| (6) 1.5 mg/l Allylthiourea + 0.5 g/l Triton x-100 | 30 |
| (7) 1 g/l $K_4Fe(CN)_6$ + 0.5 g/l Triton x-100 | 60 |
| (8) 1.5 mg/l Allylthiourea + g/l $K_4Fe(CN)_6$ + 0.5 g/l Triton x-100 | >120 |
| (9) 1.5 mg/l Allylthiourea + 1 g/l $K_4Fe(CN)_6$ + 0.5 g/l Etilan-20 | 40 |

By observing the data shown in Table 1 it can be noticed that the simultaneous utilization of the three stabilizers, forming the subject of the present invention, gives rise to a fully unforeseeable increase of the stability of the chemical copper bath. Equally surprising is the datum relating to the case (9), in which the Triton x-100 has been replaced by a surface-active agent known under the trade name Etilan-20 and produced by Lankro and which is commonly used in chemical copper baths.

Etilan-20 belongs to the same chemical family of the Triton x-100, i.e. it is a non ionic polyoxyethylenic surface-active agent and namely an ethylene polyoxide nonylphenylether with about 20 moles of ethylene oxide for each mole of nonylphenol, and therefore only slightly heavier and more hydrophilic than Triton x-100. In this case, the increase of stability due to the use of the ternary stabilizing mixture completely disappears, thus confirming that Triton x-100 does not act exclusively as surface-active agent and consequently cannot be substituted by any other surface-active agent.

EXAMPLE 2

Similarly to the Example 1, nine baths were prepared which differ in the stabilizing systems employed, corresponding to the cases from (1) to (9) of the preceding Example, but which have the following common fundamental composition:

$CuSO_4.5H_2O$: 20 g/l
HCHO: 10 g/l
EDTA: 30 g/l
NaOH: 15 g/l

Thereafter a decomposition treatment, completely similar to that described in Example 1, has been carried out. The results obtained are shown in the following Table 2:

TABLE 2

| STABILIZING SYSTEM | DECOMPOSITION TIME (minutes) at 70° C. |
|---|---|
| (1) | 1 |
| (2) | 15 |
| (3) | 30 |
| (4) | 5 |
| (5) | 30 |
| (6) | 20 |
| (7) | 50 |
| (8) | >120 |
| (9) | 30 |

As can be noticed when analysing the data shown hereinabove, the stability of the baths being considered is wholly similar to that of the corresponding cases of Example 1, thus confirming the synergical character of the ternary stabilizing mixture forming the subject of this invention.

EXAMPLE 3

As in the preceding Examples, various baths were prepared with the various stabilizing systems described in Examples 1 and 2, but which had the following common fundamental composition:

$CuSO_4.5H_2O$: 10 g/l
HCHO: 3 g/l
Rochelle salt: 30 g/l
NaOH: 9 g/l

These baths were subjected to the same accelerated decomposition treatment as described in the preceding Examples, and the results are shown in the following Table 3:

TABLE 3

| STABILIZING SYSTEM | DECOMPOSITION TIME (minutes) at 70° C. |
|---|---|
| (1) | 1 |
| (2) | 10 |
| (3) | 20 |
| (4) | 5 |
| (5) | 20 |
| (6) | 15 |
| (7) | 30 |
| (8) | >120 |
| (9) | 25 |

Once again the behaviour of the various stabilizing systems was confirmed, and the exceptionality of the case (8), corresponding to a ternary mixture of Allylthiourea, potassium ferrocyanide and Triton x-100, is emphasized by the long time necessary for the accelerated decomposition of the bath containing said mixture.

Besides the considerable stability characteristics conferred to the bath by the stabilizing system according to the present invention, also optimal are the physical characteristics of the deposits which can be obtained, and particularly gloss and ductility, as will be emphasized in the following Example.

EXAMPLE 4

Various specimens were prepared, equal to each other, formed by glass plaques roughened by a treatment with an ammonium bifluoride solution. Said specimens were catalysed in accordance with the following cycle:

| OPERATION | TIME | TEMPERATURE |
|---|---|---|
| Degreasing | 5' | 65° C. |
| Washing | 2' | 20° C. |
| Catalysis ($PdCl_2$ + $SnCl_2$ + HCl) | 5' | 50° C. |
| Washing | 2' | 20° C. |
| Acceleration (3% $HBF_4$) | 5' | 20° C. |

These specimens are then metallized by means of the baths of Example 1, at 55° C., with a contact time of three hours and with continuous stirring. The work was carried out with a load of 2 dmq/1. The results shown hereunder represent the average of at least three experimental data:

TABLE 4

| STABILIZING SYSTEM | DEPOSITED THICKNESS (microns) | DUCTILITY (number of bendings) | COLOR OF THE DEPOSIT |
|---|---|---|---|
| (1) | (decomposition) | / | dark |
| (2) | 14 | 1 | dark |
| (3) | 8.5 | 3 | dark |
| (4) | (decomposition) | / | dark |
| (5) | 9 | 2.5 | clear |
| (6) | 12 | 2 | clear |
| (7) | 9 | 3.5 | brilliant |
| (8) | 8 | 4.5 | brilliant |
| (9) | 10 | 4 | brilliant |

The ductility was determined by detaching the deposit from the glass substrate and repeatedly bending it by 180°, thereby applying every time a slight pressure to flatten the bent edge. The thickness of the deposit was determined gravimetrically, the surface of the plaque being known.

From the analysis of the data shown in the Table 4 it can be noticed that also the speed of deposition and the physical characteristics of ductility and gloss which are obtained by means of a bath according to this invention are particularly valuable and such as to ensure by themselves a considerable practical interest.

We claim:

1. In an aqueous solution for electroless autocatalytic copper plating, containing a source of cupric ions, a source of hydroxylic ions, a reducing agent, and a complexing agent in such a quantity as to render soluble the cupric ions in an alkaline medium, the improvement comprising a stabilizing mixture of allylthiourea, at least a ferrocyanide of an alkali metal or of ammonium ion, and at least an octylphenylether of ethylene polyoxide with 9–10 moles of ethylene oxide for each mole of octylphenol, the said three stabilizing components mutually exerting a synergical action.

2. A solution according to claim 1, wherein the concentration of the allylthiourea ranges between 0.1 and 10 ppm.

3. A solution according to claim 2, wherein the concentration of the allylthiourea ranges between 0.5 and 1.5 ppm.

4. A solution according to claim 1, wherein the ferrocyanide is present in the form of potassium ferrocyanide in a concentration ranging between 100 and 3000 ppm.

5. A solution according to claim 4, wherein the potassium ferrocyanide is present in a concentration ranging between 500 and 1500 ppm.

6. A solution according to claim 1, wherein the octylphenylether of ethylene polyoxide with 9–10 moles of ethylene oxide for each mole of octylphenol is present in a concentration ranging between 100 and 5000 ppm.

7. A solution according to claim 6, wherein the octylphenylether of ethylene polyoxide with 9–10 moles of ethylene oxide for each mole of octylphenol is present in a concentration ranging between 400 and 800 ppm.

8. A solution according to claim 1, wherein the source of cupric ions is pentahydrated copper sulphate.

9. A solution according to claim 8, wherein the pentahydrated copper sulphate is present in a concentration ranging between 1 g/l and the saturation.

10. A solution according to claim 9, wherein the pentahydrated copper sulphate is present in a concentration ranging between 5 g/l and 15 g/l.

11. A solution according to claim 1, wherein the source of hydroxylic ions is sodium hydroxide.

12. A solution according to claim 11, wherein the sodium hydroxide is present in a concentration ranging between 1 g/l and the saturation.

13. A solution according to claim 12, wherein the sodium hydroxide is present in a concentration ranging between 2.5 g/l and 15 g/l.

14. A solution according to claim 1, wherein the reducing agent is formaldehyde or its derivatives or precursors.

15. A solution according to claim 14, wherein the formaldehyde is present in a concentration ranging between 1 g/l and saturation.

16. A solution according to claim 15, wherein the formaldehyde is present in a concentration ranging between 2 g/l and 10 g/l.

17. A solution according to claim 1, wherein the complexing agent is N,N,N$^1$,N$^1$,tetra(2-hydroxypropyl-)ethylendiamine.

18. A solution according to claim 17, wherein the molar ratio between N,N,N$^1$,N$^1$,tetra(2-hydroxypropyl-)ethylenediamine and pentahydrated copper sulphate ranges between 1 and 10.

19. A solution according to claim 18, wherein the molar ratio between N,N,N$^1$,N$^1$,tetra(2-hydroxypropyl-)ethylenediamine and pentahydrated copper sulphate ranges between 1 and 1,5.

* * * * *